United States Patent [19]

Mackie et al.

[11] 4,159,297

[45] Jun. 26, 1979

[54] CONTINUOUS PROCESS FOR PRODUCTION OF LATENT CRIMP FILAMENTS

[75] Inventors: John K. P. Mackie; Samuel McMeekin, both of Belfast, Northern Ireland

[73] Assignee: James Mackie & Sons Limited, Belfast, Northern Ireland

[21] Appl. No.: 724,095

[22] Filed: Sep. 17, 1976

Related U.S. Application Data

[63] Continuation of Ser. No. 495,081, Aug. 5, 1974, abandoned.

[30] Foreign Application Priority Data

Aug. 11, 1973 [GB] United Kingdom ..... 39022/73

[51] Int. Cl.[2] ..... B29C 17/00; D01D 5/22

[52] U.S. Cl. ..... 264/151; 264/168; 264/176 F; 264/210 F; 264/248

[58] Field of Search ..... 264/168, 151, 248, 176 F, 264/143, 210 F

[56] References Cited

U.S. PATENT DOCUMENTS

| | | | |
|---|---|---|---|
| 3,152,380 | 10/1964 | Martin | 264/168 |
| 3,256,258 | 6/1966 | Herrman | 264/168 |
| 3,382,306 | 5/1968 | Oppenlander | 264/178 F |
| 3,422,171 | 1/1969 | Oppenlander | 264/178 F |
| 3,432,590 | 3/1969 | Papps | 264/168 |
| 3,549,743 | 12/1970 | Riordon | 264/210 F |
| 3,560,604 | 2/1971 | Papps | 264/168 |
| 3,562,369 | 2/1971 | Chopra et al. | 264/168 |
| 3,577,498 | 5/1971 | Matsuo et al. | 264/168 |
| 3,663,676 | 5/1972 | Lulay | 264/168 |
| 3,671,619 | 6/1972 | Fitzgerald et al. | 264/168 |

FOREIGN PATENT DOCUMENTS

| | | | |
|---|---|---|---|
| 39-12859 | 7/1964 | Japan | 264/176 Z |
| 41-22325 | 12/1966 | Japan | 264/168 |
| 46-19731 | 6/1971 | Japan | 264/168 |
| 47-24963 | 7/1972 | Japan | 264/176 F |

*Primary Examiner*—Jay H. Woo

*Attorney, Agent, or Firm*—Sughrue, Rothwell, Mion, Zinn and Macpeak

[57] ABSTRACT

A process for the production of crimped filaments of semi-crystalline polyolefins or blends of polyolefins with cther materials by melt drawing at 100 meters per minute or less, rapidly and asymmetrically cooling at least a portion of the filaments, forming the filaments into a tow and subjecting the tow to a heat treatment without drawing at at least 100° C. and thereafter drawing the filaments in two stages, the last of which is at a temperature of at least 70° C. With the practice of the process of this invention, there is provided a useful crimp of at least two crimps per centimeter which develops after the filaments are relaxed and subjected to a further heat treatment which may be applied either to the filaments or to products produced therefrom when in a relaxed state subsequent to drawing.

35 Claims, 5 Drawing Figures

CONTINUOUS PROCESS FOR PRODUCTION OF LATENT CRIMP FILAMENTS

This is a continuation, of application Ser. No. 495,081, filed Aug. 5, 1974 now abandoned.

This invention relates to the crimping of melt-spun filaments of polyolefins or blends of polyolefins, particularly polypropylene, with other materials. Although such filaments may readily be crimped by well-known mechanical methods, it is also possible to produce crimped filaments merely by a step of stretching, more correctly termed "drawing," subsequent to the melt-spinning process.

Drawing is that non-recoverable stretching which is carried out on the solid polymer, i.e. below the melting point, and is usually accompanied by the formation of an abrupt neck point, i.e. by an abrupt or localised reduction in the cross-sectional area of the filaments. It leads to an irreversible molecular displacement and consequent longitudinal orientation of the molecules and is carried out to increase the high strength of the fibres. Because it happens with neck formation there is a minimum value of tension necessary for any given temperature below which drawing is not produced. Tension lower than this minimum value leads to elastic extension of the filaments and this is largely recoverable.

Heat may be applied during the drawing process and in some cases, improved results are obtained by including a step of heat treatment prior to drawing. In other words, there is first an application of heat without drawing and this is followed by drawing with or without the application of further heat. These steps are normally applied to a group or groups of filaments, hereinafter referred to as a tow or tows, coming from one or more extruder heads. The results obtained vary according to the molecular weight distribution of the polymer used and the operating conditions need to be selected accordingly. It has been thought that one important requirement for the crimping of melt-spun filaments by drawing is a high spinning speed of the order of 500 to 600 meters per minute.

As described in our copending application Ser. No. 455,934 we have found that good results can be obtained independently of spinning speeds by means of a process in which at least a proportion of the filaments are rapidly and asymmetrically cooled from the melt, are formed into a tow or tows and subjected to a heat treatment of at least 100° C. and are then drawn, the extent of the heat treatment prior to the application of the drawing tension being sufficient to produce at least 2 crimps per cm. The temperature of the draw stage controls to a large extent whether or not the crimp appears immediately or remains latent until later developed by heat excitation, hot drawing leading to the greatest latency.

If the crimp development is suppressed until after the textile processing step or steps, improved bulk results, partly because no crimp is lost during the processing stage and partly because during crimping neighbouring fibres interfere with each other so that, even if all the fibres do not develop additional crimp, an overall improvement in cover results due to their displacement by fibres undergoing crimping. There is thus the double advantage in that the largely uncrimped filaments are easier to handle during the processing stage and less crimp is lost during processing.

According to the present invention, a still larger proportion of the crimp is caused to remain in the latent stage, until later developed by heat treatment, if the steps of the process just described are followed by a further stage of drawing at a temperature of at least 70° C. and preferably in the region of 90° C. and above. In other words, the first stage of drawing, which is preferably carried out hot, e.g. at 120° C. is followed by a further separate stage of drawing. These two stages of drawing are found to lead to the increased latency of the crimp formation referred to above and although one or more additional stages of drawing may be introduced if desired, two such stages are adequate and are preferred for reasons of simplicity and economy. If there are more than two such stages, it is essential that the last should be carried out at at least 70° C.

As explained earlier, drawing leads to an irreversible molecular displacement and it is the fact that, in a process in accordance with the invention, this displacement occurs in two separate stages which leads to the improved results already described. The two stages of drawing preferably occur in direct succession without any relaxation of tension. If the tension is relaxed at the end of the first stage crimp appears spontaneously, but disappears again on the application of tension for the next drawing stage and thereafter remains largely latent until subsequently developed by heat excitation.

It is found that by adjusting the degree of drawing in the two stages in relation to one another, in conjunction with the temperatures of the drawing stages, in particular that of the second drawing stage, it is possible to control both the total crimp which eventually appears after the final stage of heat treatment and also the proportion of that crimp which remains latent after the second stage of drawing. In general, it is found that both the maximum total crimp and the maximum latent crimp are obtained if somewhat less than half the total drawing is carried out in the first stage.

For example, for a first draw temperature of 120° C. and a second draw temperature of 90° C., if the total overall stretch in both stages is 3:1 and the proportions of this draw in the two stages are varied, it is found that both the total crimp and the latent crimp increase together as the proportion of the total draw in the first stage is raised from zero and then both of these values reach a maximum shortly after the proportion of the total draw in the first stage reaches a quarter, that is to say, when the stretch ratio for the first stage is slightly greater than 1.5:1. Thereafter both the total crimp and the latent crimp decrease together in a generally linear fashion as the proportion of the draw carried out in the first stage is increased and the proportion carried out in the second stage is decreased towards zero. Of course, when the proportion of the draw carried out in the second stage actually reaches zero, the process is then in accordance with the earlier application and not with the present invention. Somewhat similar results are obtained for an overall stretch ratio of 2:1, the maximum values of both total crimp and latent crimp occurring just before the draw ratio in the first stage reaches a value of 1.5:1.

The heat treatment prior to the application of the drawing tension is preferably carried out at a low tension, that is to say at a tension only just sufficient to prevent sag of the filaments as they pass through the heat treatment zone. The necessary extent of this heat treatment can only be specified in terms of the result since it depends on a number of factors, i.e. the nature of the polymer, the type and efficiency of the heating, the diameter of the filaments and the thickness of the tow or tows. Even for a very small extent of heat treatment, a minor degree of crimp will eventually result, but for practical purposes the minimum useful crimp can be reagarded as two crimps per centimeter as mentioned above and adequate heat treatment for a process in accordance with the present invention may therefore be defined as that necessary to produce at least this degree of crimp.

Although the results described can be obtained quite independently of the spinning speed, the most important advantages result from the use of a spin-draw speed of 100 meters per minute or less. Such low spin-draw speeds greatly simplify the overall process and facilitate the important requirement of rapid asymmetrical cooling. Low speed spinning can also lead to various advantages, not least of which is the possibility of passing groups of filaments directly to a twisting head so that they can be wound up on a package in the form of yarn at the same speed as they are produced, thus producing texturised yarn directly from basic polymer in a single production line.

Apart from the two stage stretching and the prior heat treatment already discussed, the most critical of the other steps is the initial cooling which, as already stated, needs to be rapid and asymmetrical. For the purpose of the present invention, the cooling may be regarded as rapid if the length of the neck portion between the full diameter of each filament and the reduced diameter resulting from the spin draw is less than 50 times the full diameter of the filaments; the faster the cooling the shorter the length of this neck portion and a neck length of less than 25 times, for example 5 times the full diameter, gives very good results. The cooling must also be asymmetrical, i.e. more intense on one side of the filament than the other. Observance of both these requirements leads to differential characteristics between one side of each filament and the other and it is these differential characteristics which are basically responsible for the ultimate production of crimp.

The rapid asymmetrical cooling is preferably applied immediately the filaments leave the spinneret plate in which case it is most conveniently achieved by directing air at the filaments as they leave the spinneret plate. This cooling air, which is preferably at or below ambient temperature, may impinge obliquely against the spinneret plate so that the filaments are cooled immediately they emerge from the orifices. The colder the air the less velocity required for the same degree of cooling.

In a particularly advantageous process the neck point of the filaments is maintained within 0.5 oms from the spinneret plate and the frost line, that is to say the level at which solidification of the filaments is complete, is approximately 1.5 cms distant.

It is not essential that the cooling should be applied immediately the filaments leave the spinneret plate and if it is applied after a short interval methods of cooling other than by air are possible. For example, the filaments may be led over the surface of a roller which is cooled either by internal refrigeration or by allowing a film of cold liquid such as water to flow over the surface in contact with the filaments. The sides of the filaments engaging the roller are cooled more rapidly than their opposite sides, leading to the differential effects already described.

The orifices of the spinneret plate may be in the form of an array having a ratio of length to breadth of at least 3:1, preferably at least 9:1, the cooling air being directed at the filaments from the longer side of the array. Normally there are two spinneret plates and hence two spaced arrays for each extruder head. Air channels are positioned at the longer outer side of each array so as to direct cooling air at the filaments. With such a form of cooling, most of the individual filaments are cooled more on one side than on the other to give the required asymmetrical effect.

The effects of the asymmetrical cooling are most marked on the filaments closest to the blast of air and if air is directed from both outer sides of the arrays, the filaments towards each of the outer edges of the array will experience the greatest differential effect, while those towards the inner edge of the array will experience only a slight differential effect and in some cases may be equally cooled on both sides and may thus not subsequently develop crimp. The proportion of uncrimped filaments which is acceptable under any particular circumstances will depend on the characteristics required in the final product. In some cases quite a small percentage of crimped filaments will be adequate while in others a fairly high proportion will be desirable.

If only a small proportion of uncrimped filaments is required, this may be obtained by blending filaments which have been crimped in accordance with the invention with uncrimped filaments. It is also possible to operate the process in accordance with the invention so that some of the filaments will develop little or no significant crimp. When the proportion of crimped filaments is fairly high, a secondary effect operates since all the filaments will subsequently be mixed together and when the crimp ultimately appears, any filaments which have not been differentially cooled may be forced into a crimped configuration by the shrinkage of the differentially cooled filaments adjacent to them.

As a result of the asymmetrical cooling, the differential characteristics are already effectively locked into the filaments by the time they have solidified and the main effect of the heat treatment is to accentuate this differential. The temperature of this heat treatment must be at least 100° C., but the amount by which it needs to be above 100° C. and also the extent of the treatment are dependent on the factors discussed previously and also the degree of crimp required. In order to provide an accurate measure of the crimp obtained for any particular operating conditions, a short length (e.g. 15 cms) of fibre is cut from the crimped tow after the crimp is developed and is placed without restraint on a glass slide and allowed to assume its natural configuration—being that of a coiled spring. The number of complete coils per "cm. of spring" is counted. The test is repeated 100 times on different fibres taken throughout the tow and the average value calculated.

Although the lower limit to the extent of heating is important, as already discussed, the upper limit is important only from the point of view of saving time and space in the overall process. It is advisable to allow a reasonable margin over and above the minimum value and when using an air oven, for example, a residence time of 45 seconds is found quite adequate for most operating conditions.

In practice the extent of heat treatment can very easily be assessed by removing a small clipping from the tow immediately on emergence from the heat treatment zone. This clipping is then hand drawn in the cold, i.e.

at ambient temperature. If the heat treatment has been sufficient spontaneous crimp will develop and this can easily be measured. This will be an indication of the total crimp to be expected after development.

Should one want a more precise knowledge of the level of heat treatment required the change in the fibre can easily be monitored by e.g. observing the change in the angle of orientation of the filaments. The heat treatment step in a method in accordance with the invention is in effect an annealing or heat setting step and like all such steps causes crystallite rearrangements: the orientation angle is a measure of the alignment of crystallites with respect to the fibre axis. The angle of orientation is a convenient means of measuring this. Its measurement has been described by Ingersol, Journal of Applied Physics 17, 924 (1946). The heat treatment will produce a change in this measured angle and is complete when further heating of the sample does not effect further change in the angle of orientation. However for practical purposes the simple hand test described above is entirely adequate.

Generally speaking, the use of an air oven for the heat treatment, as just mentioned, is most convenient and, for maximum crimp, no appreciable tension is applied. The application of tension at this stage tends to reduce the overall crimp and can be used as a control factor if required. When the tension reaches that necessary for drawing, the development of crimp may virtually be suppressed altogether, thus emphasising the importance of controlling the level of tension run-back, arising from the drawing operation, into the heat zone.

As an alternative to the use of an air oven for the heat treatment, the filaments may be heated to the necessary extent in a radiation oven.

A further advantage of the use of an oven for the heat treatment is that it is possible to carry out at least the first stage of drawing in the same oven by causing the tow to make a number of passes through the oven and by isolating the heating stage from the first drawing by suitable snubbing so as to enable the heat treatment to be of sufficient duration prior to the application of drawing tension. For example, one of the rollers around which the tow passes on its runs through the oven may be positively driven to form the snub, this roller being positioned relative to the number of passes so as to enable a heat treatment of sufficient duration prior to the drawing which will occur subsequent to that driven roller.

A still further alternative is to heat the filaments by surface contact with a heated surface or surfaces. For example the filaments may be guided into direct contact with a heated roller or rollers. Some form of snubbing means will generally be required for controlling the level of tension running back from the drawing zone to the heating zone whatever the form of heating.

Instead of a positively driven roller as described in relation to a heating oven the snubbing means may take the form of a pressure roller co-operating with a second roller or alternatively a number of rollers or bars, e.g. three rollers or bars arranged at the corners of a triangle. When using a heated roller or rollers for the heat treatment, the snubbing means will be located to control the run-back of tension from the drawing zone to the heating zone. A still further alternative for the snubbing means is to include a heated roller in the heating zone at a lower temperature than the roller or rollers preceding it.

The final drawing temperature is the most important in determining whether or not the crimp is largely latent and as mentioned earlier a temperature in the last drawing stage of at least 70° and preferably 90° C. or greater leads to the desired increase of latency. It is also found that a water bath at approximately 100° C. appears to give better results than an oven at the same temperature. This may be a matter of better heat penetration. However any suitable combination of heated surfaces, baths or ovens may be used provided the necessary heat requirements are fulfilled at each stage.

The stages so far described, that is to say the rapid and asymmetrical cooling, the heat treatment and the drawing stages may conveniently be carried out in continuous succession in the same production line, the filaments passing directly from one stage to the next. After this sequene of steps, the filaments may either pass directly to a further stage of processing, such as stapling and carding or they may be wound into packages in readiness for further processing at a later time. The latently crimped filaments can be rendered easier to handle by the application of mechanical crimp. This makes them more suitable for subsequent preparing operations such as carding.

It is also possible to interrupt the sequence of steps between heat treatment and drawing by winding the filaments onto packages after the heat treatment. This completely avoids any problems caused by the run-back of tension to the heat treatment stage.

Whatever the sequence of intermediate steps, the final step needs to be the application of heat to excite the formation of the crimp. For maximum crimp development the temperature of subsequent heat treatment is preferably of the same general order as the temperature of the heat treatment prior to drawing. This additional heat treatment is preferably dry, but wet treatment can be used if desired and can be applied at any subsequent stage after the main textile processing. It may also be advantageous to apply the heat for developing the crimp in more than one stage so that part of the crimp appears at one stage of the process, leaving the remainder to be developed by further heat at a later stage or stages.

For example, the filaments may be stapled and then spun into yarn, the heat treatment being applied to the resultant yarn. The treatment then promotes so-called "burst" in the yarn, that is to say relative movement of the fibres which tends to give the yarn more body. Thus, if the yarn in question is used as the pile yarn of a carpet, the effect of the treatment is to increase the covering power of the yarn and to give the carpet itself more body, thus permitting a lower density of yarn to be used for the same equivalent cover, with consequent resultant economies. The necessary heat for the treatment may, for example, be derived from the application of a backing to the carpet or during the finishing process. The stapled filaments can be used either alone or blended with other materials, e.g. 50% viscose.

In practice the degree of burst can be assessed at the filament production stage by taking clippings of tow after the drawing stages and heating them loosely, in an oven, for about half a minute. The temperature of the oven should correspond to that of the final heat treatment just described and will generally be between 100° C. and 130° C. The length change of the heated tow will give a measure of the crimp potential. For example, a reduction of length from 30 cm to 10 cm would represent good burst.

The invention will now be described in more detail, by way of example, with reference to the accompanying drawings, in which.

Figure 1:
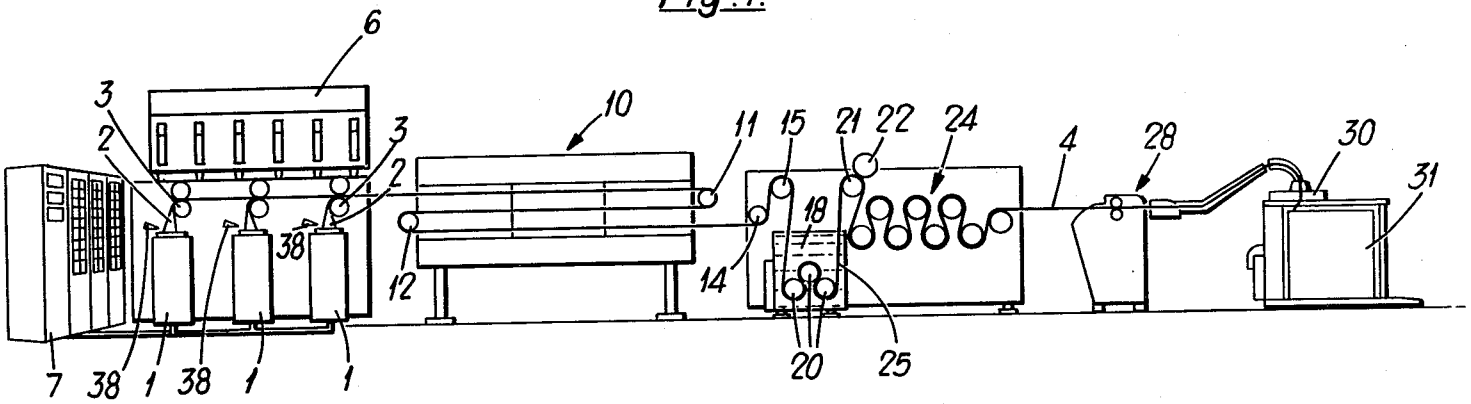
FIG. 1 is a general view showing the lay-out of a production line as a whole.

Turning first to FIG. 1, three extruders 1 are shown, each delivering filaments upwardly at 2 in the form of a tow which is passed around guide rollers 3, the individual tows being combined together to form a single combined tow 4 on which subsequent processing steps are carried out. Polymer granules are fed to the individual extruders 1 from a hopper 6 and the operation of the production line is controlled from a control panel 7.

The combined tow 4 first passes horizontally into a hot-air oven 10, being guided by rollers 11 and 12 so as to make three passes through the oven, the first two of which constitute the heat treatment and the third the first stage of drawing. To provide an effective snub and prevent the drawing tension passing back to the heating zone the roller 12 is positively driven, preferably at the same surface speed as rollers 3 so as to give minimum tension in the first two passes of the tow through the oven, thus constituting the heating zone. A temperature of at least 100° C. is maintained in this oven. The tow then passes over rollers 14 and 15 which are running approximately half as fast again as the rollers 3, 11 and 12, thus giving the first draw to the tow during its third pass through the oven. After passing around rollers 14 and 15 the tow 4 passes downwardly into a water bath 18 which contains an arrangement of three rollers 20 running at the same speed as the rollers 14 and 15. It then passes upwardly out of the water bath 18, around a roller 21 havig a cooperating roller 22 and thence to a group of Godet rollers indicated generally as 24. It is these rollers 21 to 24 which apply the tension for the second stage of drawing and the tow is thus drawn over the reach shown as 25 between the rollers 20 and the roller 21. The group of rollers 20 resist the tension applied by the rollers 21, 22 and 24, thus separating the two drawing stages of the tow, although, of course, there is no relaxation between stages.

After leaving the Godet rollers 24, the tow 4 passes to a stuffer box crimper 28 which applies a mechanical crimp and renders the tow more suitable for subsequent processing. In a typical example a nip pressure at the feed rollers into the stuffer box 28 was 65 kg per centimeter. It has been noticed that excessive nip pressure can reduce the total crimp which ultimately develops. Finally the tow passes to a coiler head 30 which feeds it into successive cans shown as 31. As each can 31 is filled with tow, it is taken away to whatever subsequent stages of processing are required as previously described.

Figure 2:
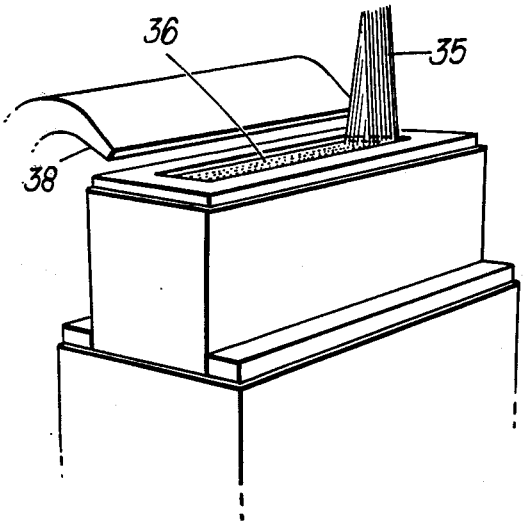
FIG. 2 is a perspective view of a single extrusion head and cooling arrangement.
Figure 3:
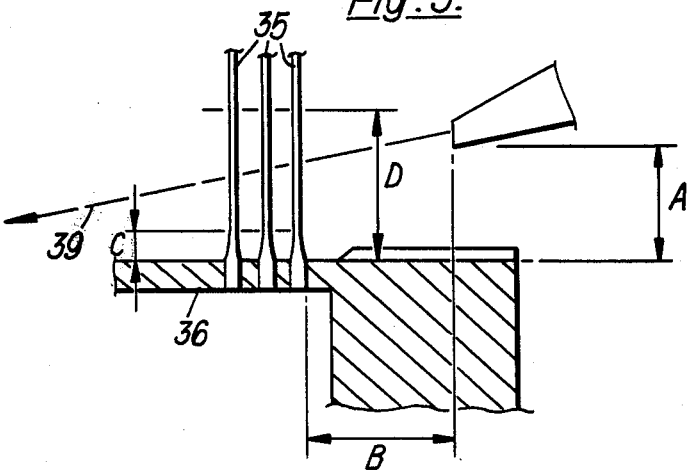
FIG. 3 is a detailed view of a small section of spinneret plate and cooling arrangement; and, FIGS. 4–5 are graphs illustrating the influence of the relative and total stretch ratios on the degree of latency and total crimp obtained.

The first of the essential steps in a process in accordance with the invention lies in the rapid and asymmetrical cooling of the filaments, which is illustrated by FIGS. 2 and 3. The individual filaments 35 are shown emerging from a spinneret place 36 and an air nozzle 38 directs a stream of cooling air obliquely against the spinneret place 36 so as to strike the die plate itself at approximately the far side of the group of filaments, as illustrated by the dotted line 39 (FIG. 3). In a particular example, the diameter of the individual filaments is 1.0 mm, the distance shown as A which represents the vertical height of the nozzle from the die plate is 12 mm and the dimension B representing the horizontal distance of the nozzle from the edge of the group of filaments is 25 mm. In this example, cooling air at ambient temperature is directed against the filaments at a velocity of 40 m/sec., leading to a neck (shown in dotted line) in the filaments at an average height of approximately 2.5 mm above the surface of the spinneret plate 36 and a frost line at an average of about 1.5 cm and represented by dotted line D. At the frost line the filaments have completely solidified and are of 60 denier.

An example of the production of crimped filaments by means of the apparatus just described will now be given in more detail. The extruder used was that known commercially as a "MACKIE CX" extruder operated with box temperatures ranging from 260° C. to 280° C. Each spinneret plate had dimensions of 400×30 mm, was held at a temperature of 280° C. and included 5880 holes each of 1.0 mm diameter. Polymer was pumped to the spinneret plates at a speed which allowed a total production rate of 90 kilograms per hour. The cooling arrangement was as already described with reference to FIGS. 2 and 3 and the air used for cooling at a temperature of 17° C. The air velocity, measured on exit from the slot of the nozzle which had a width of 0.5 cm was 40 m per second. Under these conditions of rapid and asymmetrical cooling the extruded filaments showed a neck point at an average of about 2.5 mm from the die plate, ranging from 5 mm furthest from the cooling nozzle to 1 mm nearest the nozzle. The rate of haul-off of the filaments was 9.0 m per minute.

Using the apparatus and operating conditions just described pigmented polypropylene of melt flow index 4.0 was extruded through 3 heads (2 spinneret plates per head), of the extruder, yielding a total of 32,280 filaments which were collected into a single tow. This was triple passed through the air oven 10 illustrated in FIG. 1, which was maintained at a temperature of 120° C. The tow was fed into the oven at 9 m/min and the roller 12 was maintained also at a surface speed of 9 m/min. The heat treatment duration time, constituted by the first two passes of the tow through the oven, was approximately 40 seconds. The tow was then passed around rollers 14 and 15 having a surface speed of 13.5 m/min thus giving a first draw of 1.5:1. From the rollers 14 and 15 the tow passed into the water bath 18 at 90° C. and around the three rollers 20 having a surface speed of 13.5 m/min, after which it passed to the rollers 21 to 24 having a surface speed of 27 m/min, thus providing the second stage of drawing and completing the total draw of 3:1.

(A sample of tow was taken before the roller 12 and tested for total crimp potential by cold drawing by hand. It developed 8 crimps/cm. and it was found that the orientation angle before heat treatment was 24° and after heat treatment 36°).

The tow was passed to the crimper 28 and collected in cans 31. It was stapled to 15 cms, finished with an anti-static agent and carded, prepared and spun to a 4.23 Nm yarn with a twist of 197 turns per meter and 2-folded at 118 turns/meter. The yarn was woven into an Axminster carpet which was backsized with latex and cured in an oven at 120° C. Bursting of the pile yarn took place to give a carpet with even greater cover than that resulting from the process described in our co-pending Application mentioned previously.

Figure 4:
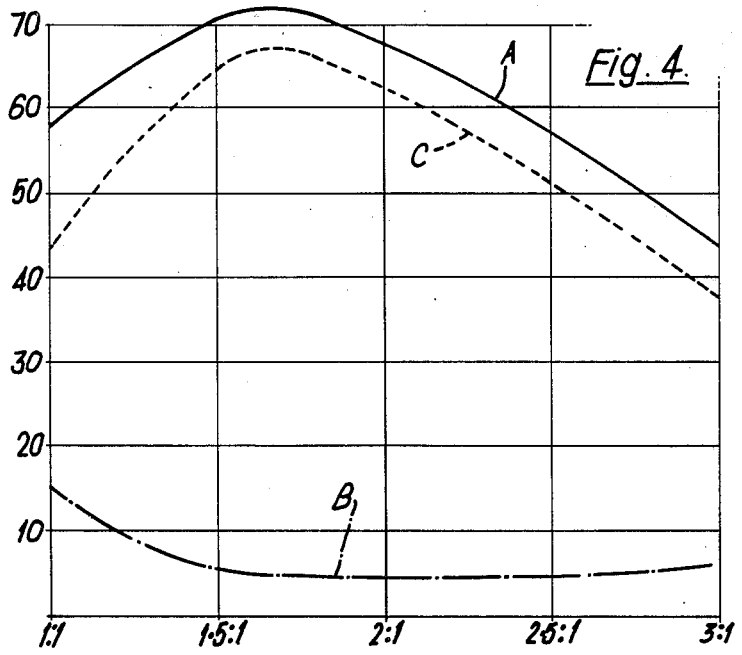
Figure 5:
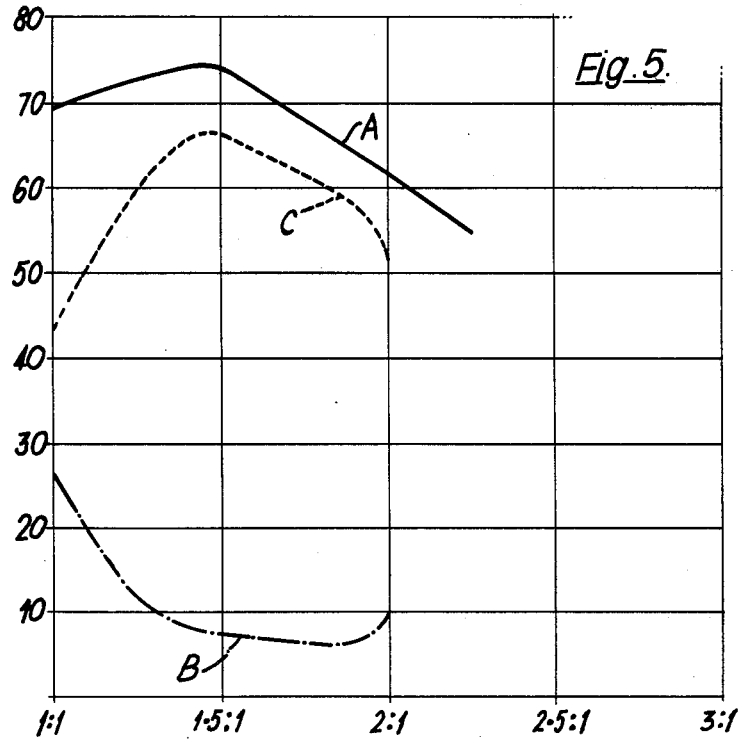

FIGS. 4 and 5 are graphs showing how changes in the first draw ratio influence the latency and total crimp level. In graph 4 the total draw (first and second draw) equals 3:1. The percentage crimp is plotted as ordinate against the first draw ratio as abscissa which is measured as a ratio of roller speed, i.e. roller 14/roller 12. The oven temperature equals 120° C., thus also giving a first draw temperature of 120° C. The water bath temperature, i.e. the second draw temperature, equals 90° C.

Curve A shows total crimp after development at 122° C., (i.e. the subsequent heat treatment). Curve B shows immediate crimp (spontaneous) developed at ambient and Curve C equals B minus A and shows the latent crimp.

Graph 5 is similarly produced but the total draw in this instance is 2:1. Slightly higher values of crimp are seen to be obtained at this lower total draw.

The extra latency derived from the process gives even more scope for bulk development in multi-stages. Thus, for example, the yarn may be treated in boiling water to develop part of the crimp and the remainder can then be developed as a result of the latex curing of the carpet. As a result of bulking occurring partly in the yarn prior to insertion as tufts in the carpet and partly after insertion in the carpet, a carpet is produced which has not only maximum cover but also excellent tuft definition.

It will be appreciated that a process in accordance with the invention is advantageous, not only for carpet production, but also for many other textile processes, not least being its suitability for the formation of non-wovens, particularly by the spun-bonded route where the squirming of the fibres during crimp development of the latent crimp improves randomisation and consolidation of the batt.

We claim:

1. A continuous sequential process for the production of filaments having latent crimp and containing a substantial portion of semi-crystalline polyolefine, which process consists essentially of the steps of:

melt-drawing said filaments at a speed of less than 100 m/min from a spinnerette plate, projecting cooling gas so that it impinges asymmetrically against at least a portion of said filaments while melt-drawing the filaments, and controlling the drawing and cooling to solidify the filaments during a length of draw where the neck portion of an individual filament is 5 to 50 times the full diameter of said filament, forming said filaments into a tow, advancing said tow without drawing while heat treating the tow at a temperature of at least 100° C., but below the melting point of said filaments, said heat treatment being continued to change the angle of the orientation of the crystallites of the asymmetrically cooled filaments with respect to the axes of the filaments, the degree of asymmetric cooling in conjunction with the heat treatment causing the formation of at least two crimps per centimeter upon subsequent drawing and relaxation of said filaments, and then subjecting said tow to at least two stages of drawing without intermediate relaxation including a last stage of drawing at a temperature of at least 70° C. whereby the resultant crimp is controlled by the degree of drawing and temperature of each stage of drawing in relationship to the parameters of said heat treatment so that said crimps remain at least partially latent for heat development subsequent to the last drawing step.

2. The process of claim 1 wherein the filaments are extruded upwardly from the spinnerette plate.

3. A process according to claim 1, in which the temperature during the last stage of drawing is in the region of 90° C.

4. A process according to claim 1, in which there are two stages of drawing.

5. A process according to claim 1, in which the temperature during the first stage of drawing is at least 100° C.

6. A process according to claim 1, in which said filaments are extruded from a spinneret plate and are rapidly asymmetrically cooled by directing cooling air at said filaments as they leave said spinneret plate.

7. A process according to claim 6, in which the cooling air impinges obliquely on said spinneret plate.

8. A process according to claim 6, in which the cooling air is at ambient temperature.

9. A process according to claim 7 in which the cooling air is below ambient temperature.

10. A process according to claim 6, in which the neck point of the filaments is maintained on average within 2.5 mms from said spinneret plate and the frost line is on average approximately 1.5 cms distant from said spinneret plate.

11. A process according to claim 1, in which said heat treatment prior to drawing is carried out in an oven.

12. A process according to claim 11, in which said oven operates by hot air.

13. A process according to claim 12, in which the first stage of drawing is carried out in said oven.

14. A process according to claim 1, in which the heat treatment prior to drawing is carried out by surface engagement with at least one heated roller.

15. A process according to claim 1, in which the filaments are heated for the last stage of drawing by passing through a heated bath.

16. A process according to claim 15, in which the filaments are drawn between said bath and following driven rollers.

17. A process according to claim 1, in which the first stage of drawing occurs over a heated surface.

18. A process according to claim 17, in which said heated surface is stationary.

19. A process according to claim 1, in which the level of tension running back into the heat treatment zone is controlled by snubbing means.

20. A process according to claim 1, in which said filaments are subjected to a further heat treatment in a relaxed state subsequent to drawing.

21. A process according to claim 20, in which the subsequent heat treatment is at approximately the same temperature as the temperature of the heat treatment prior to drawing.

22. A process according to claim 20, in which the filaments are subjected to a mechanical crimp subsequent to drawing and prior to the following heat treatment step.

23. A process according to claim 1, in which the polyolefin is polypropylene.

24. A process according to claim 1, in which the filaments produced by the process are stapled to form fibres.

25. A process according to claim 1, in which said filaments are blended with other materials.

26. A process according to claim 24, in which said staple is spun into a yarn.

27. A process according to claim 26, in which the subsequent heat treatment is applied to the yarn.

28. A process according to claim 1, in which said filaments are divided into groups and twisted to form yarns as a further step in the continuous succession.

29. A process according to claim 1 in which said filaments are incorporated in a non-woven web.

30. A process according to claim 29 in which said filaments are cross-lapped and subsequently consolidated.

31. A process according to claim 30, in which said filaments are consolidated by needling.

32. A process according to claim 29 in which subsequent heat treatment to develop the crimp is applied to said web before consolidation.

33. A process according to claim 29 in which subsequent heat treatment to develop the crimp is applied to said web after consolidation.

34. A process according to claim 29, in which said filaments are melt bonded.

35. A process according to claim 1, in which subsequent heat treatment to develop the crimp is applied in more than one stage.

* * * * *